US006302342B1

(12) United States Patent
Danforth et al.

(10) Patent No.: US 6,302,342 B1
(45) Date of Patent: Oct. 16, 2001

(54) PULPER CONE ASSEMBLY FOR HANDLING SLABS OF REEL BROKE BALED PULP AND THE LIKE

(75) Inventors: Donald W. Danforth, Andover; Glen I. Urquhart, Southboro, both of MA (US)

(73) Assignee: Bolton-Emerson Americas, Inc., Lawrence, MA (US)

( * ) Notice: Subject to any disclaimer, the term of this patent is extended or adjusted under 35 U.S.C. 154(b) by 0 days.

(21) Appl. No.: 09/477,848

(22) Filed: Jan. 5, 2000

Related U.S. Application Data

(63) Continuation-in-part of application No. 08/923,679, filed on Sep. 4, 1997, now Pat. No. 6,053,441.

(51) Int. Cl.[7] ..... B02C 19/12
(52) U.S. Cl. ..... 241/21; 241/46.11; 241/261.1
(58) Field of Search ..... 241/46.11, 46.17, 241/261.1, 261.2, 21

(56) References Cited

U.S. PATENT DOCUMENTS

| | | | | |
|---|---|---|---|---|
| 3,428,261 | | 2/1969 | Moulton | 241/21 |
| 4,365,761 | * | 12/1982 | Danforth | 241/21 |
| 4,440,352 | * | 4/1984 | Rossler | 241/152.2 |
| 5,613,430 | * | 3/1997 | Lee | 241/261.1 X |
| 5,785,261 | * | 7/1998 | Lanner | 241/36 |

* cited by examiner

*Primary Examiner*—John M. Husar
(74) *Attorney, Agent, or Firm*—Peter J. Manus; Dike, Bronstein, Roberts & Cushman

(57) ABSTRACT

A pulper has a circular rotor that carries a set of peripheral blades that rotate within a stator having a set of peripheral lobes that interact with the peripheral blades as they rotate to reduce and defiber materials, e.g., to produce pulp slurries for paper-making. A cone assembly is mounted over the center of the rotor on a base plate. The cone assembly includes a blade that extends across the common axis of rotation of the base plate and the rotor and projects into a tank beyond the height of the peripheral blades and the stator lobes. A support structure, preferably in the form of a "cone", supports the blade. The cone preferably has a pyramidal structure and in one form extends sufficiently far up the blade so that, typically, no more than 2 to 3 inches of the blade project above the outer surface of the cone. The blade has a triangular structure terminating in a central apex for use in reducing slabs of large sheet materials such as reel broke. The blade has a rectilinear configuration, with a generally linear free edge, which is effective when used with baled pulp. In another form, the blade is generally rectangular, but has a set of saw teeth formed on its free end. The support structure used with this saw tooth blade configuration preferably includes a pair of triangular legs bracing the blades in its upright orientation from opposite sides. Other triangular members each span the blade-to-leg spaces and are rigidly secured at all three sides to form a pyramidal cone structure.

13 Claims, 10 Drawing Sheets

PULPER CONE ASSEMBLY FOR HANDLING SLABS OF REEL BROKE BALED PULP AND THE LIKE

REFERENCE TO RELATED APPLICATIONS

This application is a continuation-in-part of U.S. Ser. No. 08/923,679, filed Sep. 4, 1997, entitled "Toroidal Flow Pulper for Difficult Materials", now U.S. Pat. No. 6,053,441.

BACKGROUND OF THE INVENTION

This invention relates in general to reduction and defibering machinery and methods for the paper and pulp industry. More specifically, it relates to an improved pulper construction and a method of operation for a pulper that (1) control blanketing of the rotor-stator by large sheets of stock material to be pulped and (2) rapidly and reliably break up this large sheet material.

Pulpers are used in the paper and pulp industry to reduce a stock material such as wood pulp into a watery slurry suitable for making paper. The stock material is added to a tank of water that feeds a pulper where the stock material is broken down into fibers of a suitable size and consistency to make the desired paper product.

U.S. Pat. No. 4,365,761 discloses a pulper that uses a rotor and stator operating at a close clearance (e.g., 0.010 inch) to defiber a variety of materials which had prior to that invention been impossible to defiber. These materials were termed "unconventional" or "difficult" and included cotton, hemp, flax, rag, leather, high wet strength papers, synthetic fibers, sheets of stock formed of fibrous materials bound by adhesives, and in particular, the high wet strength board known as "shoe board". The rotor and stator described in the '761 patent are configured to "acquire" and cut difficult materials with a scissors-like action at a size reduction interface having a truncated conical geometry. This interface is defined in part by a series of generally triangular segments, or "lobes" of the stator. Each lobe curves along an outer edge of a generally circular base and inclines inwardly. The inner surface of these lobes defines a conical, as opposed to a cylindrical, interface. An outer cutting edge of the blades, on the base of the rotor, define the inner boundary of this interface. Scissoring action occurs between these blade cutting edges and the leading edge of each triangular stator lobe. Once acquired and reduced to a sufficiently small size, the material is defibered in the attrition zone of the pulper between the lobes and the outer edges of the blades.

To date the '761 pulper, sold by Bolton-Emerson Americas, Inc. of Lawrence, Mass. under the registered trade designation "Tornado®" is the only commercial pulper which can handle such materials. The Tornado® pulper is believed to be used to prepare the slurries that make about half of the paper currencies now in circulation throughout the world.

The energy input to the Tornado® pulper is used to reduce in size and defiber the stock material, to recirculate the flow of defibered stock back to the pulper (or, alternatively, to transfer stock downstream on a continuous basis), and to agitate the stock held in the tank using a toroidal flow. The pulper must also effectively deal with problems such as the tendency of some stock to float or to settle in the tank ("submergence"), plugging of the defibering mechanisms, and "slugging" due to the rapid introduction of a mass of difficult material to the acquisition and attrition zones of the rotor-stator pair.

While the '761 Tornado® rotor-stator design works well, it has difficulty in processing large slabs of sheet material such as reel broke and bales of "market" or "purchased" hard or soft wood pulp being recycled into paper. Reel broke is rewound (reel), off-specification printed paper, typically in ten to twenty foot lengths with a typical 40 inch diameter. A guillotine splits these reels lengthwise, and this split reel broke is added to the pulper tank. Depending on how it enters the tank, it can open into a large slab that covers the rotor. This blocks a central axial flow of water and stock 42 (FIG. 1) to the rotor-stator pair to limit, or substantially stop, the flow of stock material to the attrition zone of the rotor-stator pair for defibering. 500 to 550 pound bales of pulp, typically in three foot by four foot by one and a half foot stacks, are added to the pulper tank after outer wire wraps are cut off the bales. Large sheets of the freed pulp can then blanket the rotor, or slide off the rotor and sink to the bottom of the tank. Submerged baled pulp resting at the tank bottom is not processed, or is eventually processed, but slowly. In a continuous operation where slabs of reel broke, baled pulp or the like are continuously added to the tank, if these large sheet materials are not rapidly and reliably pulped, the slurry in the tank can become overly viscous.

The prior art "Tornado®" pulper uses a smooth, curved nose cone, e.g., the one denoted by reference number 32 in the '761 patent. It covers several bolts securing the rotor to a drive shaft and it re-directs a central, axial in-flow into a flow that is radially outward to an acquisition zone where the blades on the periphery of the rotor interact with the surrounding stator lobes.

A seeming straight-forward solution to the blanketing problem, mounting a central projection on the cone to hold off the large sheet materials, in fact only spears or drills the sheet materials. The speared slab remains intact and blankets the rotor. Such a projection then adds to the problem in that it holds the sheet material in place over,the rotor. The use of non-central projecting members to control blanketing is contra-indicated by the tremendous forces acting on any member so situated. Other problems with such projections are increased power needs, increased turbulence, and the tendency of cotton and stringy stock materials to wrap around the projections.

It is therefore a principal object of this invention to provide a pulper nose cone construction and a method for operating a pulper that control blanketing of the pulper's rotor and stator by large sheet stock materials to be pulped.

Another principal object is to provide a nose cone construction and pulping method that not only control blanketing, but also rapidly and reliably break apart the sheet material.

Another object is to provide such a construction and method without altering the construction or mode of operation of known rotor-stator interfaces capable of handling difficult materials.

Still another object is to provide a construction and method of operation of a pulper that operates in a continuous or batch mode and greatly increases the throughput rate for such large sheet stock materials as compared to known such pulpers.

Yet another object is to provide a nose cone construction and method of pulper operation with the foregoing advantages that are durable and characterized by additional power requirements within the capacity of conventional drives for pulpers that can reduce and defiber difficult materials.

SUMMARY OF THE INVENTION

A pulper for difficult materials includes a stock and water holding tank with a rotor-stator pair mounted in the tank, typically a side-wall of the tank. A motor and drive shaft rotate the rotor within the stator. The stator has a generally circular base with a side wall typically in a series of generally triangular, curved, and inwardly inclined lobes arrayed around its periphery. The rotor is a generally circular plate that carries a set of upright blades mounted on the plate and configured to interact with a leading edge of the stator lobes in a scissors action as the rotor rotates. The blades and lobes define an acquisition zone where the stock is caught and cut in this scissor action to reduce it in size to a level where it can be defibered by 1) a milling action between the blade edges and cutting edges formed at bars and channels on the inner surface of each lobe and 2) a chopping action between a series of teeth formed on the outer periphery of the rotor and opposing bars on the side wall of the stator at or near its base. The rotation of the rotor blades pumps the water and stock material in the tank in a toroidal flow pattern.

To control blanketing and to break up large sheets of stock material, the pulper replaceably mounts a cone assembly on the rotor at its center. The cone assembly includes a circular base plate, blade oriented generally at right angles with respect to the base plate with a free edge projecting into the tank beyond the rotor-stator pair, and a blade support structure secured between the base plate and the blade. The blade extends across the base plate, preferably along a diagonal. In one form the support structure is pyramidal, formed of four generally triangular sheets of a structural material such as sheet steel. The blade is a sheet of structural material secured to, or formed integrally with, the support structure and/or the base plate. The free, projecting end of the blade has a V-shape, is convexly curved, or extends along a generally straight line. In a preferred form, the blade is a stainless steel plate with a thickness of at least ⅝ inch, and preferably ¾ inch.

In another embodiment, the cone assembly blade is generally rectilinear in shape, with a saw tooth configuration along its free edge. The blade is preferably welded at its lower end to the base plate. The support structure includes a pair of generally triangular legs oriented on end, transversely to the blade, and mutually aligned along a diagonal. A set of four triangular side plates are each welded or otherwise secured between the blade and one of the legs to produce a pyramidal structure that braces the blade and reduces the power loss due to a pumping action of the rotating blade and support legs.

Viewed as a process, the invention includes the steps of boring into slabs of large sheet stock materials with a free edge of an upright blade mounted for rotation with a rotor of a pulper, and repeatedly impacting the large sheet materials being bored with a side of the rotating blade thereby breaking the sheet material into pieces that can be acquired by the rotor stator pair for further size reduction and defibering. The process further includes mechanically supporting the blade during the boring and repeated impacting. In its preferred form, the supporting (1) at least in part, extends to a point closely spaced from the blade free edge, and (2) also limits the exposed surface area of the blade available to interact with the water and stock material in the tank.

These and other features and objectives of the present invention will be more fully understood from the following detailed description that should be read in light of the accompanying drawings.

DETAILED DESCRIPTION OF THE PREFERRED EMBODIMENTS

Figure 1:
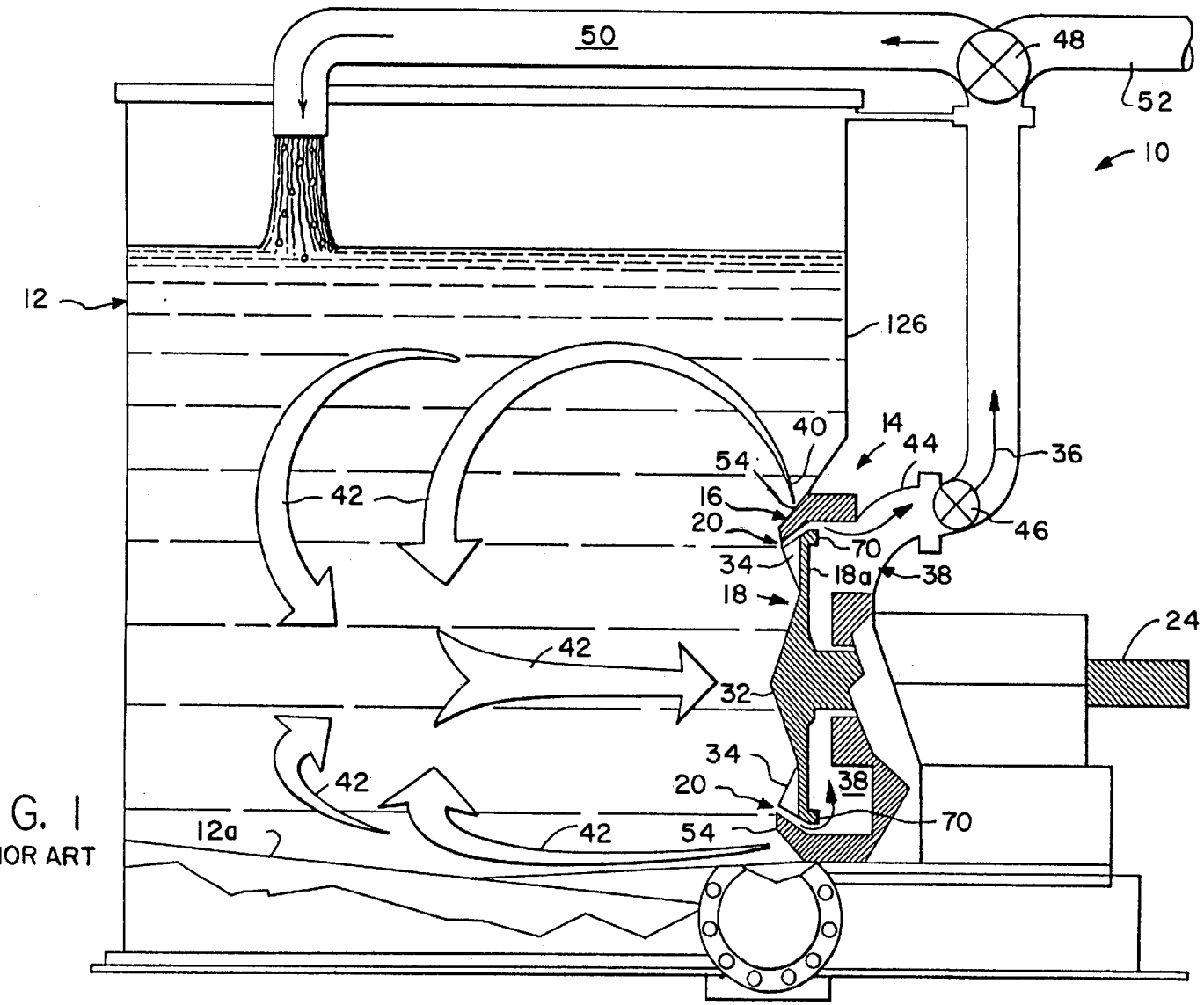
FIG. 1 PRIOR ART
FIG. 1 is a view in vertical section and partially in side elevation of a known pulper showing the flow of stock in a tank and through a rotor-stator pair.
Figure 2:
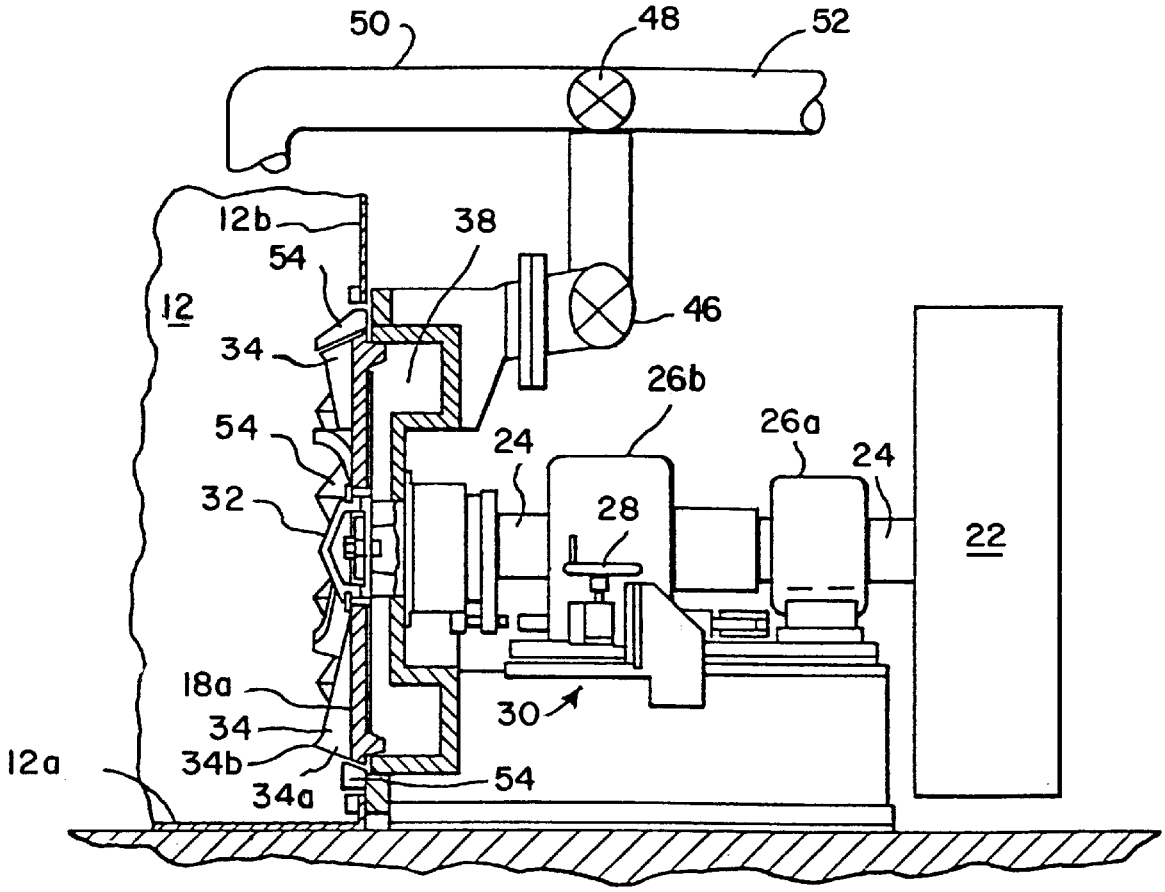
FIG. 2 PRIOR ART
FIG. 2 is a detailed view in side elevation and partially in vertical section showing the rotor-stator pair of FIG. 1 in more detail.
Figure 3:
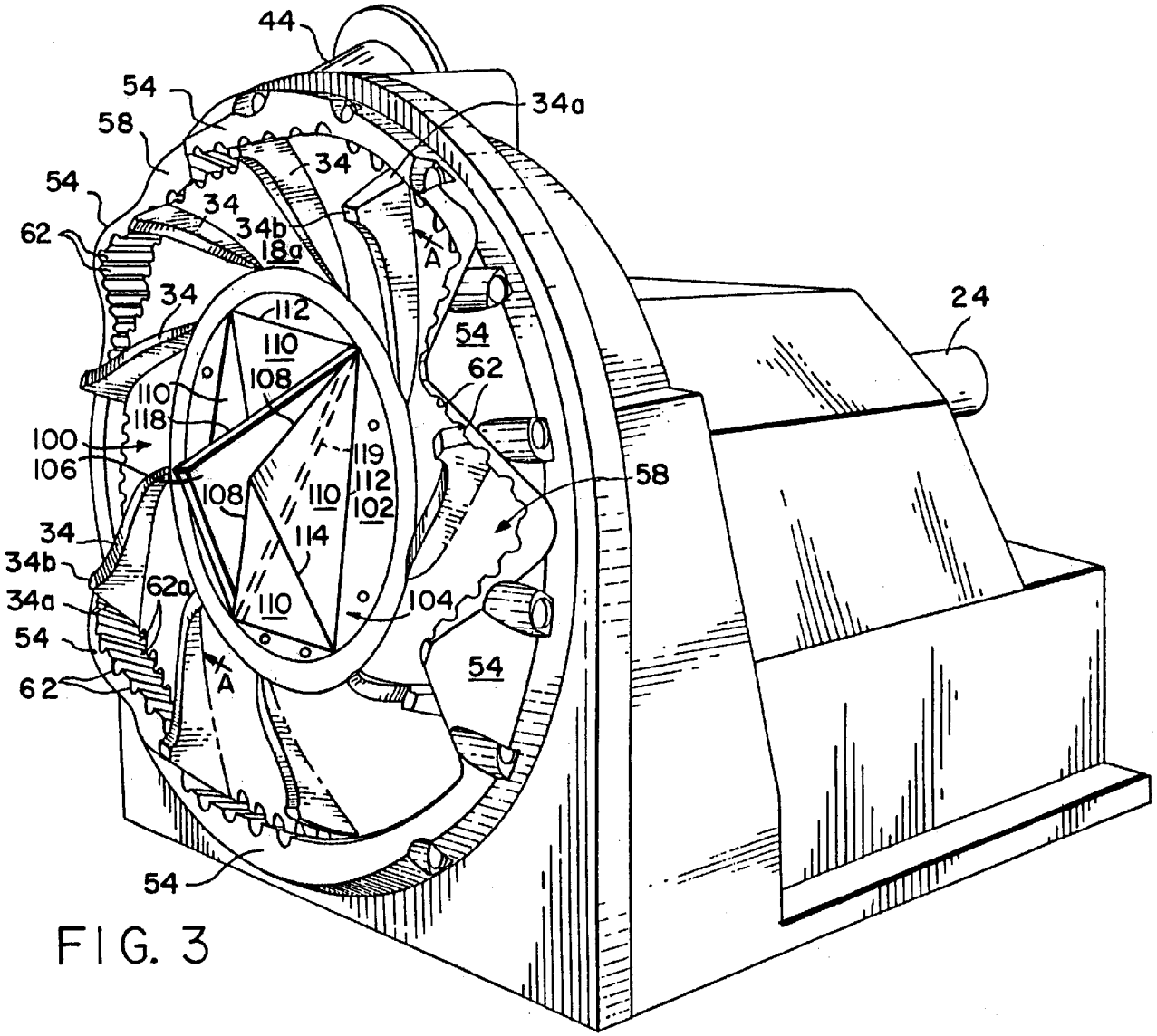
FIG. 3 is a perspective view of the pulper shown in FIGS. 1 and 2 without the tank, drive motor, power transmission train, or flow conduits, but modified to include a nose cone assembly according to the present invention.
Figure 3A:
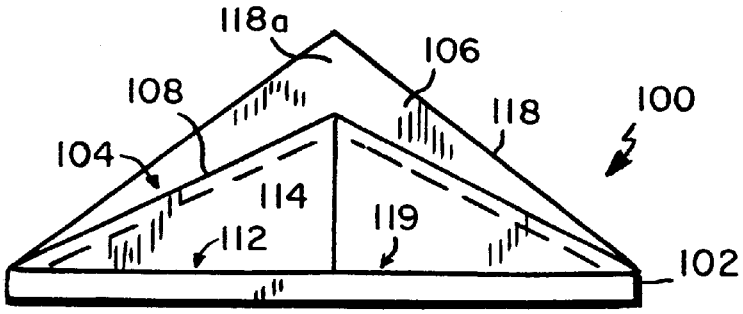
FIG. 3A is a view in front elevation of the nose cone assembly shown in FIG. 3.

FIGS. 1–3 show a system 10 according to the present invention which includes a stock-holding tank 12 and a defibering pulper 14 with a stationary stator 16 and a nested, rotatable rotor 18 which together define a reduction and attrition interface 20. For many applications the interface has a slight clearance, typically 0.005 to 0.010 inch, that is uniform around the interface. However, for some applications the clearance may be reduced to zero, and, in still other applications, it is desired to use thrust, that is, to advance the rotor further to increase the power demand and to increase significantly the -effectiveness of the pulper.

The tank 12 can assume a variety of shapes. As shown it is generally cylindrical with a bottom wall 12*a*, and a side wall 12*b*. With the stator construction such that the area of the stator at the rotor-stator interface is less than 50% of the total area of this interface to increase the power supplied to agitation of the stock held in the tank, the tank can have a large volumetric capacity as compared to typical tanks for pulpers operating in a batch mode. A typical capacity for the tank 12 can vary from 2,600 to 5,000 gallons. In terms of batch capacity in pounds, the 2,600 gallon tank can hold 1,000 pounds at a 5% consistency in a 7.5 foot inside diameter tank that is 9.0 feet high. A typical large tank, e.g., one with a 12-foot diameter, can handle at least a 2,000 pound batch.

The stock held in the tank is formed by adding to a supply of water a charge of a material to be defibered into the water. The invention can be used with conventional materials, but it is particularly designed to reduce in size and then to defiber difficult materials used in making paper and paper products such as raw (or cooked) cotton, stockboard stock, hemp, flax, rags, heavy latex impregnated shoe board and the like, as well as a wide variety of other materials such as a MSW, the agricultural products noted above, fish, manure, used books and magazines, and the like to make the fuel, fertilizer, mulch, compost and food products and the like, also mentioned above.

The present invention is particularly addressed to the pulping of slabs of reel broke, baled pulp, and the like, which, when freed of any exterior bindings and added to the tank, can assume the configuration of sheets of the material of sufficient size, and with an orientation and position in the tank, to cover the rotor-stator pair. This "blanketing" of the rotor-stator impedes, or substantially stops, its operation. Herein such slab stock materials, ones capable of blanketing the rotor-stator pair, are termed "large sheet".

A motor 22 rotates a drive shaft 24 journalled in a set of mutually spaced bearings 26*a*, 26*b*. A handwheel 28 operating a gear and rack assembly 30, or an equivalent linear translation mechanism, moves the drive assembly axially to allow adjustment of the rotor-stator clearance at the interface 20 through an axial movement of the rotor 18 secured to one end of the drive-shaft. The drive-shaft is highly rigid to transmit a large torque and to resist bending moments that would displace the rotor and destroy the uniformity of the clearance 20.

The rotor 18 is organized about a circular plate 18*a*. A prior art nose cone 32 is shown in FIG. 2 bolted to the rotor plate 18*a*. A set of circulation blades 34 project from the plate 18*a* into the tank. The blades can be cast integrally with the plate 18*a*, welded, or otherwise attached. The rotor also includes a peripheral flange that thickens the rotor axially at its outer edge. The flange stiffens the plate, but the flange 70 extends axially beyond merely the length needed to stiffen the rotor. This extra length, preferably at least double what has been used for stiffening alone, has been found useful in extending rotor life due to wear. The flange has a cylindrical outer surface that wears to a conical surface.

The blades are central to the defibering through the interaction of a blade edge 34*a* and cooperating cutting and attrition edges formed or carried on the stator. They also act as pumping elements to produce the desired flow of stock in the tank to the attrition zone. Their rotation drives 1) a defibered stock flow 36 through the interface 20 to an extraction chamber 38 for recirculation or use and 2) a radial flow 40 out of the interface 20 which produces a toroidal flow 42 in the tank 12. The toroidal flow 42 agitates the stock in the tank; it mixes the material in the tank and continuously sweeps stock, particularly along the tank walls and along the stock surface, to the center of the tank where it is carried to the pulper 14. The useful energy applied to the system 10 by the pulper 14 is applied to size reduction and defibering, recirculation, and agitation. The rotor-stator construction can defiber a wide range of unconventional materials and maintain a recirculation flow while also developing a sufficiently strong toroidal agitation flow 42 so that stock held even in a large capacity tank is defibered successfully. However, as noted above, slabs of reel broke, baled pulp and other large sheet materials, if not rapidly broken apart, or held in a blanketing position over the rotor-stator, tend to sink to the bottom of the tank where they are heavy enough to resist being carried by the toroidal sweeping flow to the pulper.

The recirculation flow 36 of defibered stock exits the extraction chamber 38 via conduit 44, a valve 46, and a valved "T" connection 48 which directs the flow either back into the tank 12 and/or to an outlet conduit 52, e.g., one that feeds a tank supplying a paper-making machine. The system 10 can be operated in a batch or continuous mode, with recirculation, or with a variable rate of recirculation as a percentage of the total flow through the pulper 14. The valve 48 controls the outflow rate from the pulper.

The stator 16 is organized around a generally annular, integral base 16*a* which carries a set of curved, circumferentially extending lobes 54. Each lobe 54 has the general configuration of a solid triangle that is inclined inwardly toward the axis of rotation of the drive-shaft and rotor. The inclination and curvature of each lobe is such that the inner surfaces of the lobes define a truncated conical surface that is the outer boundary of the interface 20. The inner boundary is defined, with a slight clearance of a few thousandths of an inch (or essentially no clearance in a "thrust" mode of operation), by the locus of the edges 34*a* of the moving rotor blades 34. The lobes 54 are preferably integral with the base 16*a*.

As described in detail in the aforementioned U.S. Pat. No. 4,365,761, which disclosure is incorporated herein by reference, the blade edges 34*a* and the leading, or "acquisition" blade edges 54*a* of each lobe 54 meet at an angle of 15° to 55°, and preferably at about 25° to create a scissor-like cutting action as the rotor rotates within the stator. This action is termed "acquisition" in the '761 patent, and the valleys 58 between lobe peaks are termed "acquisition spaces." This is the space where large pieces of the materials are caught and cut into smaller pieces which can then enter and be further reduced and defibered in an attrition zone 60 defined by the mill-like attrition produced between the blade edges 34*a* and series of "vertically" extending bars 62 and channels 62*a* formed on the inner surface of each lobe. Further chopping-action attrition occurs through the interaction of a set of teeth 18*c* formed on the outer edge of the rotor with the opposite stator wall with the lower portions of the bars 62 and channels 62*a*. Screws 56 received in axial holes 56*a* at the outer edge of the stator mount it.

To increase agitation the surface area of all of the stator lobes 54 is kept at a value less than 50%, and preferably about ⅓, of the total surface area of the truncated conical interface 20. This relationship produces a strengthened radial flow out of the pulper, and a correspondingly strengthened toroidal agitation flow 42—one sufficiently strong to agitate, mix and sweep floating and settling material in the tank into the pulper. The precise value of the area reduction will depend on the specific application. However, as noted above, even with this increased agitation flow large sheet materials can settle on the tank bottom and then resist being swept to the pulper.

This stator lobe area reduction must be symmetrical around the stator so as to avoid producing moments on the rotor and the drive-shaft that would adversely affect the uniformity of the rotor-stator clearance 20. This area reduction must also be carried out in a way that does not create other problems such as plugging, cavitation, or a reduction in the ability of the pulper to acquire, reduce in size, and defiber stock material.

Figure 8:
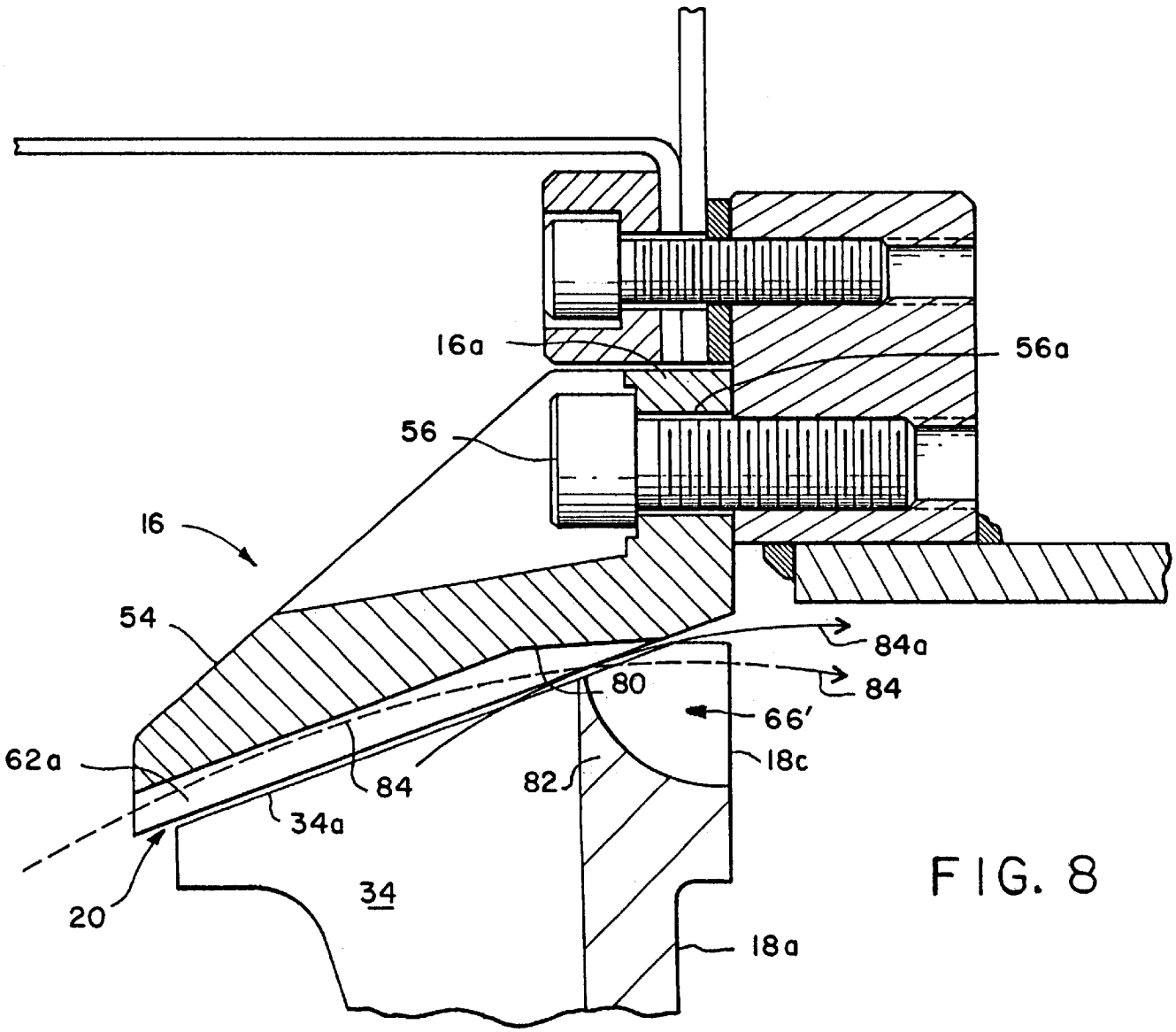
FIG. 8 is a detailed view showing a deflector arrangement to enhance homogeneity of treatment and uniformity of fiber length.

FIG. 8 illustrates deflectors 80, 82 on the stator and rotor, respectively, which force the stock being defibered to flow through the chopping-action attrition zone defined by the peripheral rotor teeth 18*c* and the opposite channel and bar surface of the stator. In the '761 prior art pulper, the channels 62*a* extended generally in a straight line. As a result, material being defibered could flow straight into the extraction chamber 38, thus by-passing the chopping action of the teeth 18*c*. The deflectors 80, 82 are preferably cast in place as integral extensions of the stator base 16*a* and rotor plate 18*a*, respectively. The deflectors 80, 82 are positioned, configured, and sized, as shown, to force the stock flow pumped down the channels 62*a* by rotation of the blades 34 (as shown by flow arrows 84 and 84*a* in FIG. 8) into the attrition region where the teeth 18*c* can act on the fibers. Each deflector 80 can be formed simply by tapering the lower end of the channels 62*a* in the form of a flat ramp that terminates short of the rear face of the station. Each deflector 82 on the rotor is preferably formed by machining (or casting) the spaces 66' between the teeth 18*c* not to extend through the rotor plate, but rather to curve to the outer edge 34*a* of the blade 34, as shown. It is thus integral with the rotor plate 18*a*.

While the preferred form of the deflection 80, 82 are shown and described, they can assume a variety of forms as long as they: i) divert the flow through the channels 62*a* (defining a first milling-action attrition zone) to a second chopping-action attrition zone defined by the teeth 18*c* and the opposed bars 62; and ii) block a by-pass flow that would otherwise avoid the second attrition zone by flowing through the openings between the teeth 18*c*. For example, the deflectors 80 can have curved, rather than flat, surfaces interacting with the flows. Rather than being integral, the deflectors 80, 82 can be solid or sheet metal deflectors welded, or otherwise secured, in place on the stator and rotor. The internal shape of the deflector 82 can also vary, e.g., it can have a more squared internal corner, that is, one that does not thin radially toward the interface 20. Further, while there is a loss in performance as compared to using both deflectors 80 and 82, it is possible to use only one of the deflectors 80 and 82 to enhance homogeneity of treatment and uniformity of fiber length. This is because with one deflector some portion of the defibered stock flow can bypass the second, milling-action attrition zone.

To cut and defiber these difficult materials, the drive-train must transmit a substantial torque. For paper and pressboard applications, typical rotor speed is 430 rpm at 350 Hp. For cotton and like applications, a typical rotor speed is 380 rpm. A 1200 rpm capacity motor delivers 250 Hp to a 36-inch diameter rotor steady-state with peak demands in excess of 300 Hp when stock is introduced. The reaction forces on the rotor-stator pair are likewise substantial. Despite the use of hardened steel alloys for cutting and attrition edges, there is steady wear on the rotor and stator at the interface 20. Wear can be progressively compensated by advancing the rotor axially toward the stator using the handwheel 28.

Figure 9A:
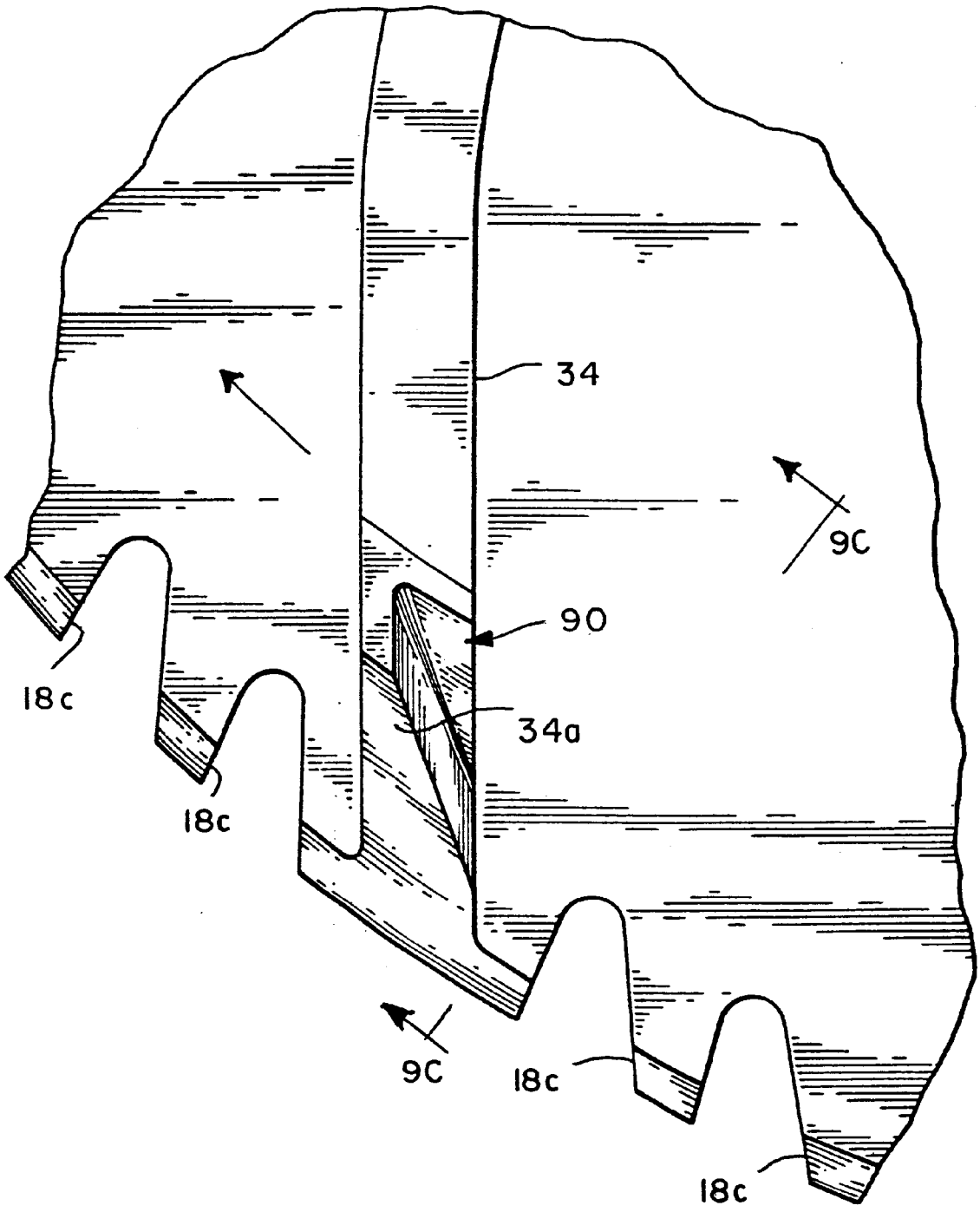
FIGS. 9A and 9B are detailed views in top plan and end view of the profiled rotor blade end.
Figure 9B:
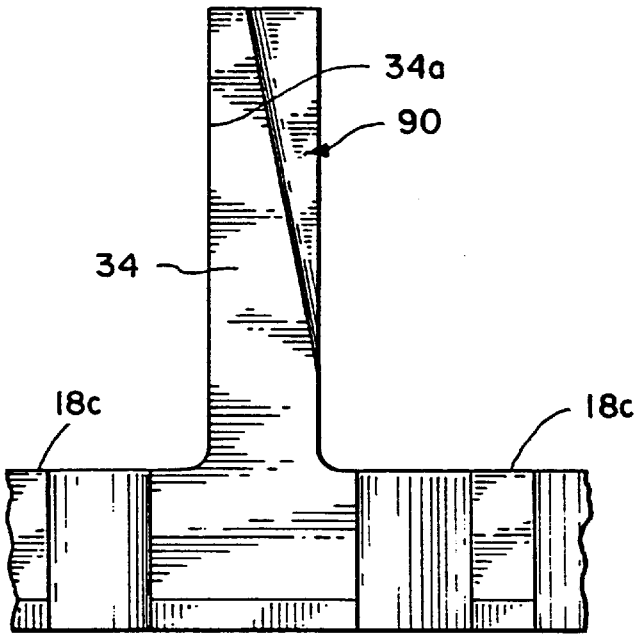
Figure 9C:
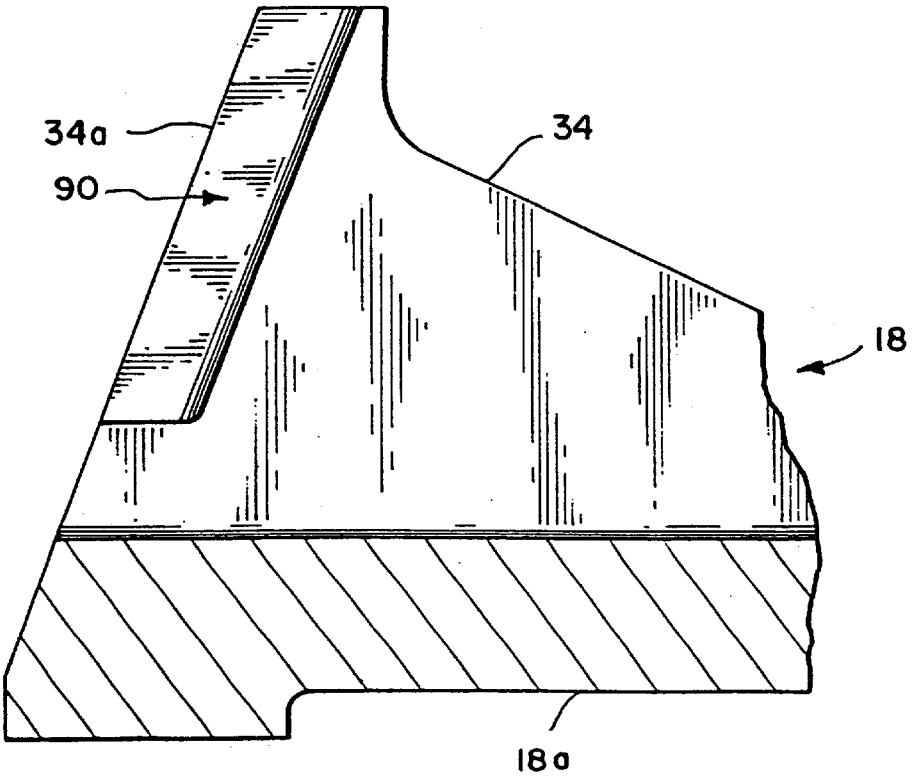
FIG. 9C is a view along line C—C in FIG. 9A.

FIGS. 9A–9C illustrate a profiled blade end 90 useful in controlling wear when very abrasive materials are being defibered, e.g. flooring base material containing an abrasive material. The profile 90 is in the form of a generally wedge-shaped recess machined in the upper, trailing end of blade edge 34*a*. The widest end of the recess is at the top of the blade resulting in the thinnest part of the blade at its uppermost end. This configuration avoids a concentration of wear at the upper edge of the rotor-stator interface where the abrasive material first enters. Instead, the profile reduces the available surface for rotor-stator wear at the upper end and facilitates its entry into the interface as a point closer to the rotor plate 18*a*. This distributes the wear more evenly over the interface, providing a longer life. The precise shape and size of the profile is not critical as long as it performs these functions. The wedge shape shown, with a flat, ramp-like configuration, is preferred for ease of machining, but it could be curved. By way of illustration, but not of limitation, for 36 inch diameter rotor and about 3.5 to 4.0 inch tall rotor blades, the wedge-shape extends axially for 2.75 inch, leaving the blade with a thickness (in the direction of rotation) of 0.25 inch at its tip. The wedge in its preferred form shown is uniform and extends over about 80% of the height of the blade edge. The wedge recess has a thickness, in this example, of about 0.5 inch at the blade tip. Variations in the configuration and dimensions of this profiling are limited by the strength and rigidity required of the blade and its wear characteristics in use which can be determined empirically and/or though conventional stress analysis techniques.

FIGS. 3–7B show various forms of nose cone assemblies 100 according to the present invention. They are adapted to facilitate the pulping of large sheet stock materials. The nose cone assemblies each have a base plate 102, a support assembly 104, and a blade 106. The support assembly, like the prior art cone 32, is termed herein a "cone" in that it and the other components of the assembly 100 cover the bolt attachment of the rotor to the drive shaft 24 (see FIGS. 1 and 2) and redirect the axial flow of stock and water toward the pulper 12 into a generally radial flow to the attrition zone 20. However, the support structure 104 also is constructed and positioned to brace the blade 106 against the tremendous lateral forces applied to the rotating blade as it slams, with a sledge-hammer-like action, against the content of the tank, particularly large solid masses such as reel broke and baled pulp. Further, the support structure 104 is preferably constructed to enclose a portion of the blade to reduce the power lost to the pumping action of the blade as it rotates in the water and stock held. The blade 106 and support structure 104 are rotationally symmetrical to balance the pulper during operation.

The blade 106 is preferably formed from a sheet of hardened stainless steel at least ⅝ inch thick, and preferably ¾ inch thick. The blade 106 is preferably a plate-like member that is upright with respect to the base plate 102 and, in the preferred form, extends "laterally" generally along a diagonal of the base plate. In the FIGS. 3–5 embodiments, it is sandwiched between, and continuously welded at 108 to, the adjacent edges of generally triangular plates 110 that together form a pyramid shaped "cone" support structure 104. The plates 110 are also continuously welded at 112, or otherwise reliably secured, to the base plate 102, and to one another along an inclined lateral weld 114. While the base plate is circular, it preferably has a square central opening within the base of the cone support structure 104. This opening clears the rotor-to-drive shaft attachment bolts and facilitates the fabrication of the nose cone assembly 100. The plates 110 and base plate 102 are also preferably stainless steel, although not necessarily hardened, and of a type that readily welds or otherwise is secured to the blade material and is resistant to corrosion in the operating environment of a slurry tank. The base plate has a set of peripheral, axially directed, openings 116 sized to accept large diameter bolts or the like to mount the nose cone assembly 100 onto the rotor 18, or more specifically, to its base 18*a*. Eight, twelve or sixteen equiangularly spaced opening 16 sized to accept ¾ inch diameter bolts are preferred. The number used depends on the size of the unit.

Figure 7B:
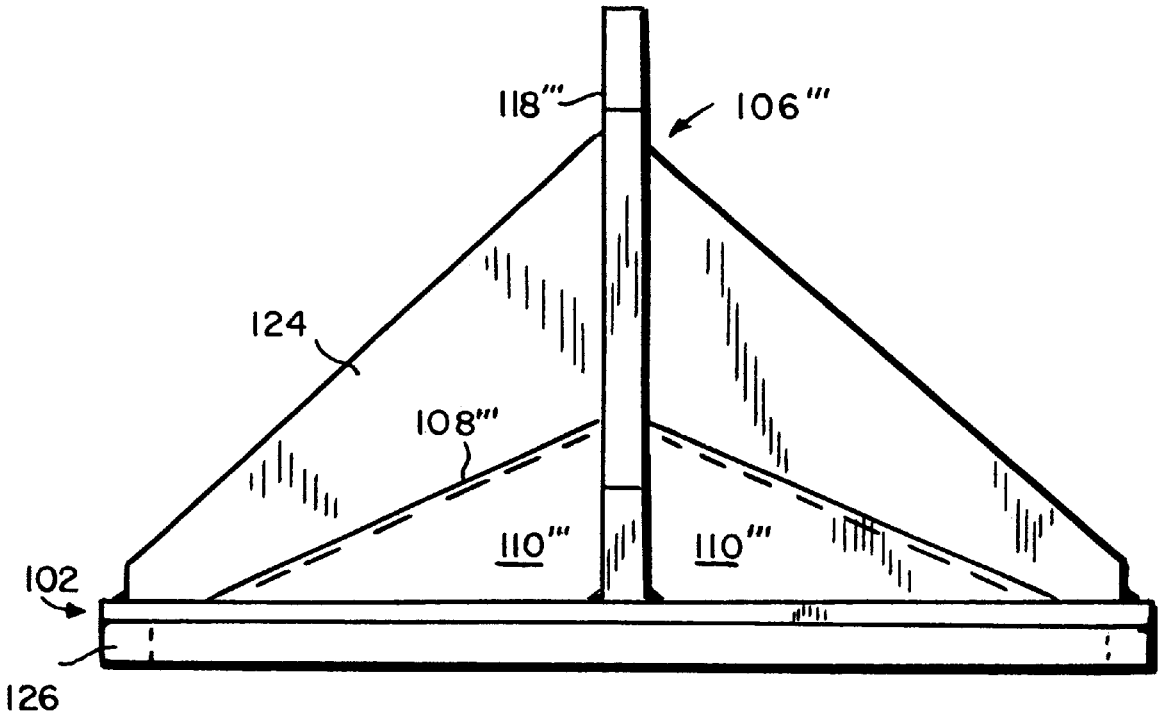
FIGS. 7A and 7B are views in side elevation taken along the lines A—A and B—B, respectively, in FIG. 6.
Figure 5:
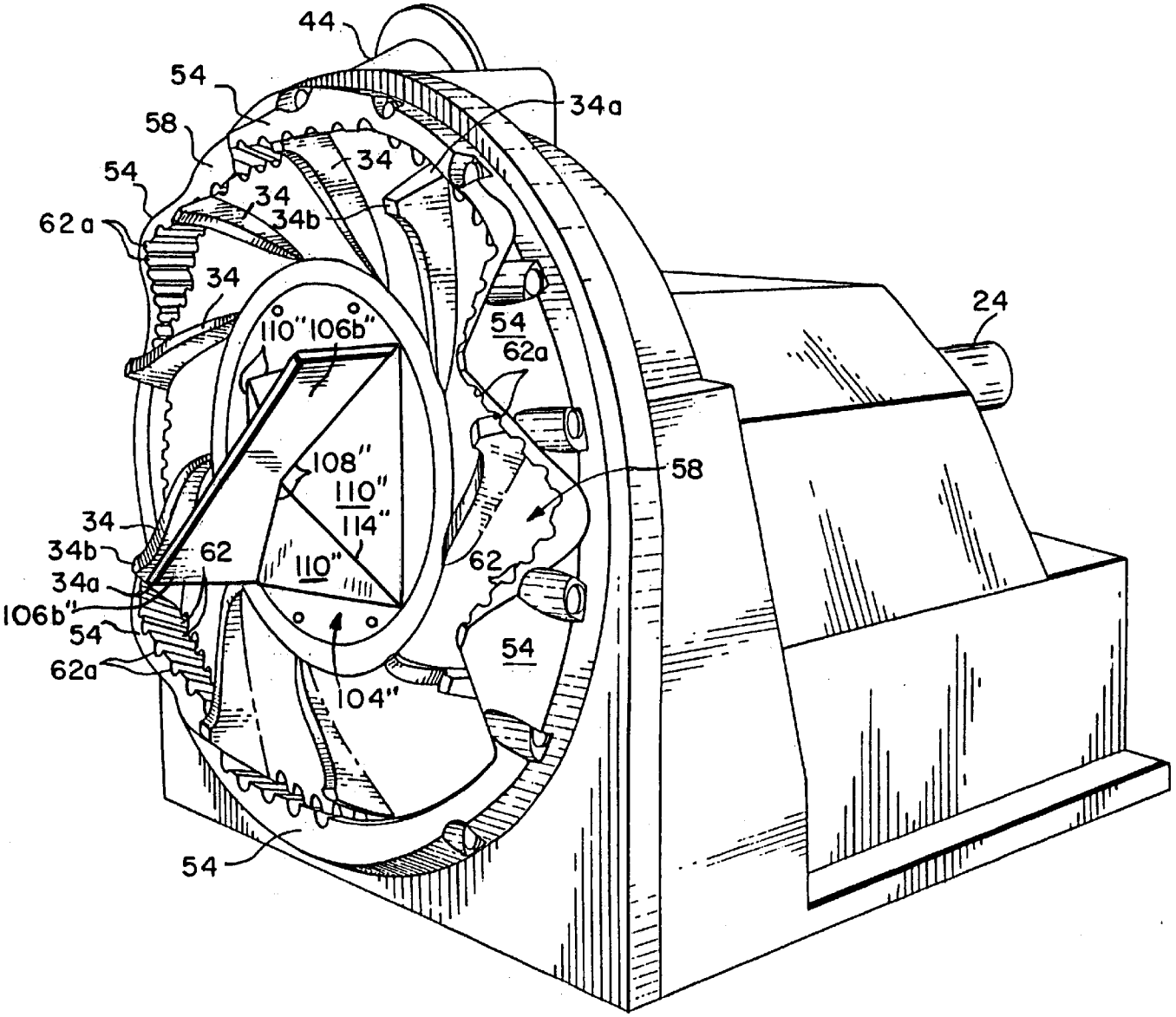
Figure 6:
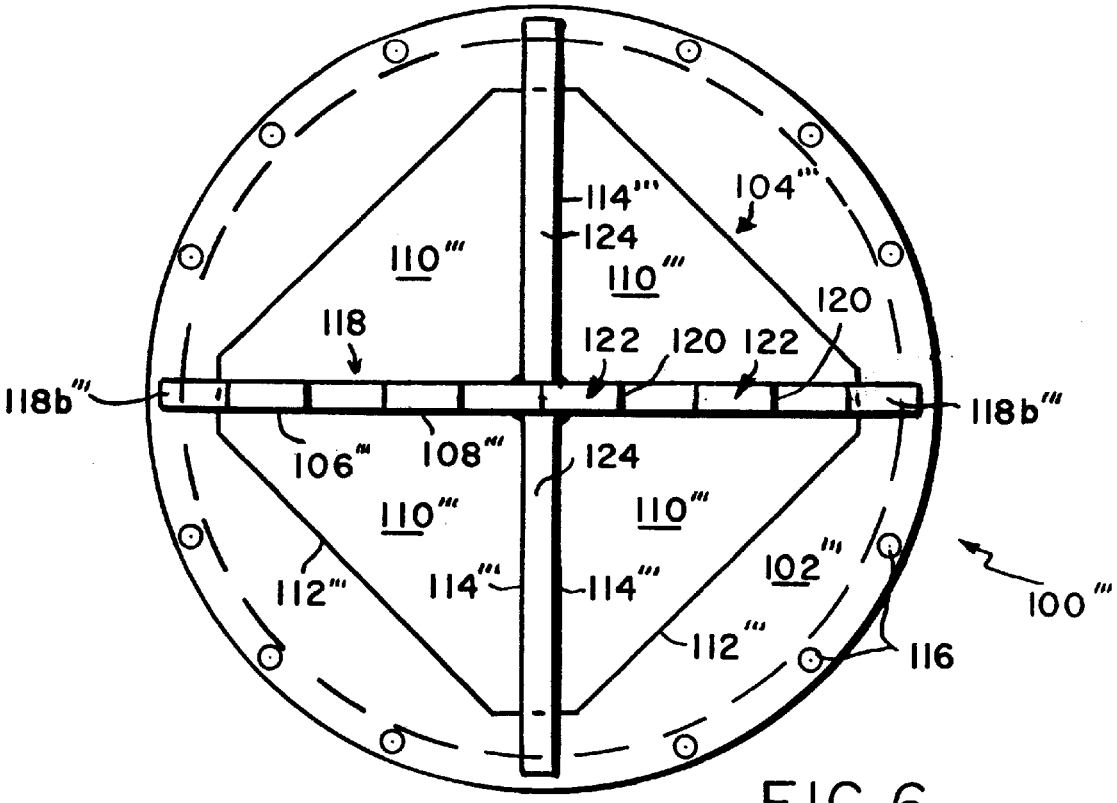
FIG. 6 is a top plan view of yet another embodiment of the nose cone assembly of the present invention.

The blade 106 can extend "downwardly" within the support structure, and be further supported by being welded, or otherwise secured, to the base plate 102 as in the FIGS. 6–7B embodiment. In the FIGS. 3–5 embodiments, while the blade extends axially beyond the support structure, it is supported close to its projecting free edge 118, and preferably no more than 3 inches from the adjacent support structure. A spacing of at least 2 inches is a preferred lower limit to allow the blade to penetrate into the sheet material. As one moves from the center of the assembly 100, the impact forces on the blade become greater due to the higher peripheral speed of the blade at a larger radius. Therefore, in the embodiment shown in FIGS. 3 and 4, the distance from the support structure 104 to the free edge decreases as a function of radial position.

The blade 106 shown in FIG. 3 has a V-shaped free edge 118. The free edge 118 need not be sharpened. It and the adjacent leading blade face may be hardened. The apex 118*a* has an enclosed angle in the range of about 80° to about 120° and about 90° to 100° in its presently preferred form. The blade 106 is particularly well suited to processing reel broke. The V-shaped blade bores into the reel broke. Then rotation of the blade in the bore, with the bore helping to hold the broke in position on the blade, repeatedly slams the blade on the reel broke, causing it to rapidly and reliably disintegrate into smaller pieces that can be further reduced in size and defibered by the rotor-stator pair. The toroidal flow in the tank also assists in urging the reel broke onto the blade and holding it there. The dimensions and configuration of the blade can vary, as long as it (1) has the physical strength to resist being deformed as it engages and then repeatedly impacts over its length the large mass of the large sheet material, and (2) it avoids merely "spearing" the sheet material. This combination of boring and blade-wide impact actions prevents the material from sliding off the nose cone assembly (and perhaps submerging), or becoming impaled on the blade while still blanketing the rotor-stator pair.

Figure 4:
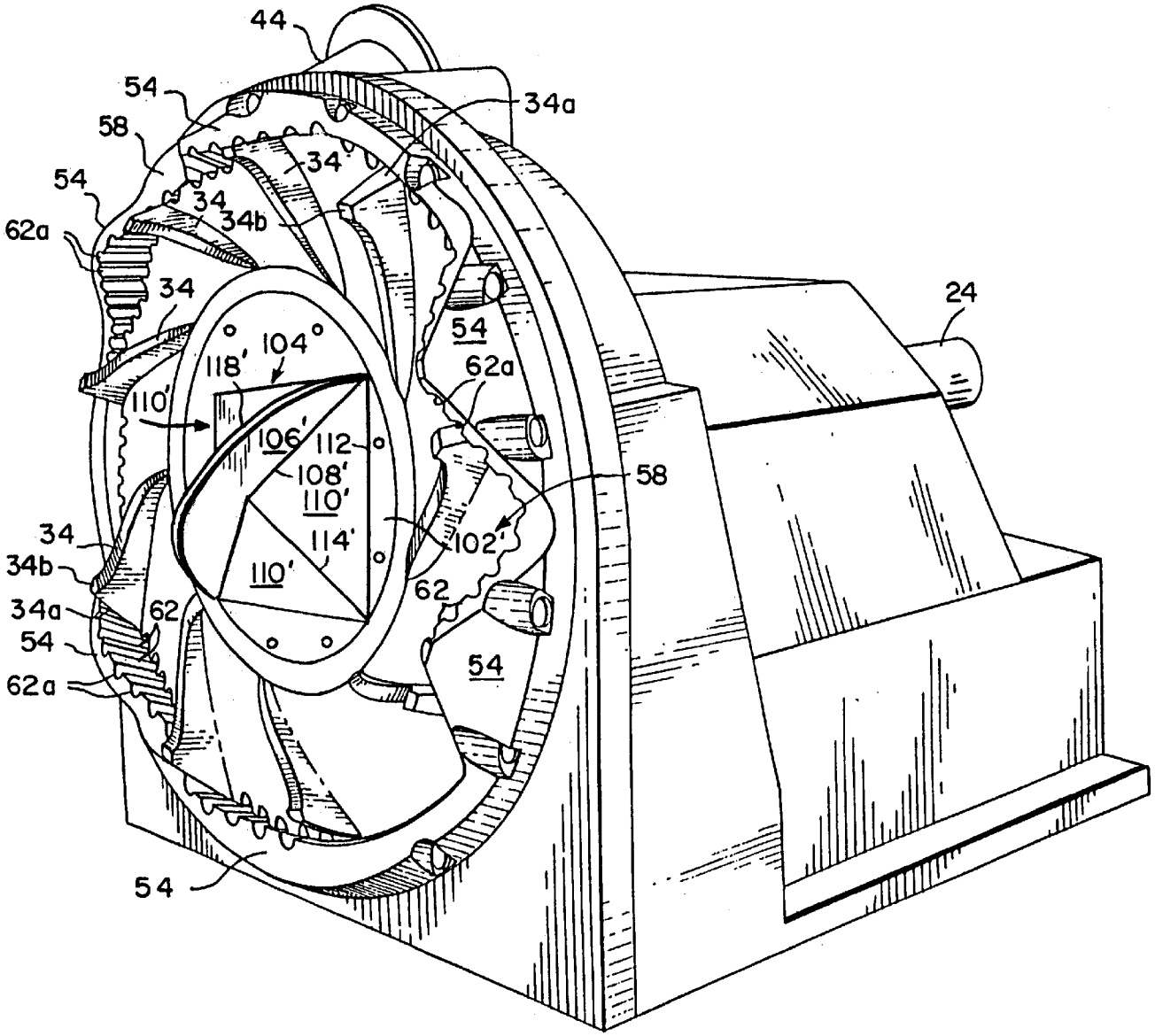
FIGS. 4 and 5 are views corresponding to FIG. 3, of alternative embodiments of the nose cone assembly of the present invention.

The blades 106' and 106" shown in FIGS. 4 and 5, respectively, (like parts in the various embodiments having the same reference number, but distinguished by primes) are constructed and operate the same as the blade 106 except that their free edges 118' and 118", respectively, are curved (106', 118') and linear, generally parallel to the base plate (106"). These configurations have been found to be effective in breaking apart baled market pulp. The curved blade provides some boring effect, but with an enhanced blade-face impact area and a reduced blade height at the blade periphery for strength and durability. The rectangular blade 106", provides two comers **106*b*", 106*b*" that can bore into large sheet stock material that is angled from an orthogonal relationship with respect to the axis of rotation of the blade. The large blade face area of the rectangular blade 106", which extends over substantially the full width of the rotor cone assembly, provides a large blade-on-stock-material impact area, particularly at the outer portions of the blade where its tangential speed, and hence its impact force, is the greatest. The blade 106" is therefore, in general, more effective, but it is also more prone to corner bending or other damage due to the larger forces it is subjected to than the blades 106 or 106'**. It also consumes more power in operation, other factors being equal.

FIGS. 6–7B show another embodiment of the present invention, one which is presently preferred for most applications. The blade 106"' has a generally rectangular shape, like the blade 106", but its free edge 118" has a saw tooth configuration of alternating, generally triangular teeth (or peaks) 120 and valleys 122. Four teeth are shown, but other numbers can be used. The support structure 104"' also differs from the structure 104 shown in FIGS. 3–5. Two triangular legs 124 lie diametrically opposite one another and at right angles to the blade 106"'. The legs 124 are each welded or otherwise rigidly secured to the blade and to the base plate 102"' at its centerline. Four triangular plates 110"' each incline and span a blade-to-leg region to form a pyramid cone support like those described above with respect to FIGS. 3–5.

Figure 7A:
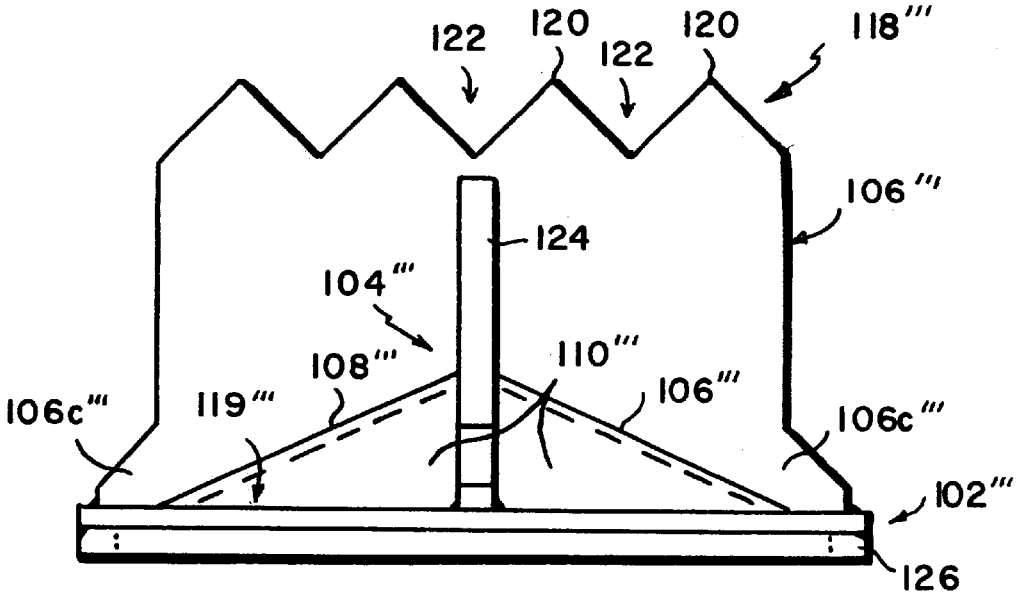

As show in FIGS. 7A and 7B, the legs 124 extend axially to a point closely spaced from the bottom of the central valley 122. For purposes of illustration only, a blade 106"' that extends diagonally about 16.0 inches at the free edge 118"', this spacing is preferably about 0.5 inch. In turn, the inclination of the plates 110"' is such that they support the legs at about 40% of their full axial height and the blade at about 35% of its full axial height. This is roughly 3.5 inches from the base plate 102"' for the assembly shown with a 16.0 inch edge 118"'. The blade has shoulders **106*c*", 106*c*"' that widen the blade to almost the full diameter of the base plate, 20 inches in this example. The lower edge 119"' of the blade 118"' is preferably continuously welded to the base plate, as are the lower edges of the legs 124, 124 and the plates 110"'. The base plate 110"'has a peripheral flange 126 that stiffens the plate and provides a clearance for the rotor attachment. The base in this example is ½ inch thick and the flange extends axially another ¾ inch. A set of axially directed holes 116"', twelve as shown in FIG. 6, receive mounting bolts (not shown) to replaceably secure the entire cone assembly onto the rotor. When so assembled, the free edge 118"', and the edges 118, 118' and 118" in the other embodiments of this invention, extend axially beyond the tallest member of the rotor-stator pair to promote a preferential engagement of the cone assembly with the large sheet stock material. Size reduction of these materials can also be assisted by truncating the stator lobes 54 and lengthening several equiangularly spaced ones of the rotor blades 34**.

The support structure 104"' can, of course, also be used in conjunction with blades of the general type shown in FIGS. 3–5, particularly the rectangular blade 106" configured to extend down to the plate 102" and mounted with its lower edge welded to the plate 102".

Viewed as a process, the present invention operates in the context of a pulper using a rotor with a set of upright blades driven by a central drive shaft to rotate within a surrounding stator. The rotor-stator pair is mounted in a tank containing a water and stock material mixture. Rotation of the rotor sets up a toroidal flow in the tank that feeds the stock axially to the rotor-stator pair where the stock is reduced in size—due to the scissoring action between the rotor blades and edges of the triangular stator lobes—and defibered.

The present invention, viewed as a process, adds to this pulping process the further steps of mechanically boring into large sheet stock materials such as opened reel broke and opened baled pulp placed in the tank, and, simultaneously with the boring, mechanically impacting the large sheet stock material, beginning at and around the bore site, to break up the sheet material into smaller pieces that can then be processed by the rotor-stator pair. In the preferred form, these boring and impacting actions are carried out by rotating a blade rigidly mounted to and across the axis of rotation of the rotor, and mechanically supporting that blade in an on-edge or upright position so that it can withstand the massive forces tending to deform and detach the blade during these operations. In the preferred form, this supporting also limits the surface area of the rotating member available to pump the water and stock in the tank. This controls turbulence that can otherwise interfere with the toroidal flow within the tank established by rotation of the rotor blades that sweeps stock material in the tank axially toward the rotor-stator pair for size reduction and defibering at their attrition interface.

In operation, the cone assemblies of FIGS. 3–7B can reduce a 550 pound bale of market pulp in about 15 seconds, or less. This allows the pulper to increase a processing rate from a maximum value of about 400 tons/day for a known pulper using a conventional, smooth cone assembly 32, to at least 500 to 600 tons/day with the FIGS. 3 and 4 ("V" and curved blade) embodiments, about 900 tons/day with the FIG. 5 (rectilinear blade) embodiment, and even greater thoughput rates with the FIGS. 6–7B (saw tooth) embodiment. No pretreatment of the stock material is required. In practice, the ripping and sledge-hammer actions of this invention in net effect causes reel broke, baled pulp, and the like to "explode" apart when it encounters the pulper. Slabs of large sheet material are rapidly and reliably broken apart before they can blanket the rotor-stator. Baled materials are exploded into pieces of stock of a size suitable for processing by the rotor-stator pair before the bale submerges. This improved operational capability is achieved without altering the basic pulper construction or placing power demands on the pulper beyond the capacity of known drive systems for such machinery. The cone assemblies of the invention are durable, and do not require frequent maintenance, e.g., removal for sharpening of cutting edges, or because of wear or physical deformation.

While the invention has been described with respect to its preferred embodiments, various modifications and alterations will occur to those skilled in the art. For example, while the invention has been described with respect to a cone assembly having a single blade mounted along a diagonal of the rotor and/or the cone assembly base plate, it is possible to use multiple blades, such as three, four or more blades each extending along a radius and evenly angularly spaced from one another. These alternative arrangements, however, increase the piece count and fabrication costs, and in operation, they increase turbulence in the tank and have an increased power consumption as compared to a single blade due to this increased turbulence and the increase in the number of times a blade impacts the stock material in one revolution. These structures also do not have the strength and integrity of an integral, one-piece construction. While the blades and support structure have been described as welded to one another and to the base plate, they can be cast as a single piece, or assembled at least in part with bolts, for example, ones inserted through openings in the plate and threaded into holes in the bottom of the blade and support members. The shape of the free blade edge can also assume forms other than those described and shown, as long as the blade design is consistent with the design principals described above. The leading blade edges can be sharpened and/or hardened. The face of the blade impacting the stock material can also be hardened with carbides. Likewise, the support structure can assume a variety of other forms. The pyramid configuration produced by flat plates 110 can become more truly conical by using curved plates. The legs 124 can be supplemented with extra like leg supports at other locations along the blade or blades. These and other modifications and variations that will occur to those skilled in the art from the foregoing detailed description and drawings are intended to fall within the scope of the appended claims.

What is claimed is:

1. A cone assembly for a rotor-stator pair of a pulper that can operate continuously to reduce in size and defiber large sheet stock materials added to a water-filled tank of the pulper, comprising, a base plate secured to the rotor and rotating in unison with the rotor about a common axis of rotation, an upright blade extending across said base plate with a free edge projecting into the tank, and a support structure secured to said base plate and said blade, said support structure being configured and sized with respect to said blade to provide mechanical support for the blade as it engages and breaks apart the large sheet stock materials.

2. The rotor of claim 1 wherein said support structure is pyramidal.

3. The rotor of claim 1 wherein said blade free edge is V-shaped.

4. The rotor of claim 1 wherein said blade free edge is linear.

5. The rotor of claim 1 wherein said blade free edge is convexly curved.

6. The rotor of any of claims 1–5 wherein said blade is formed of stainless steel and has a thickness of at least ⅝ inch.

7. The rotor of any of claims 1–5 wherein said blade at its center projects axially from said support structure by a distance in the range of 2 to 3 inches.

8. The rotor of claim 7 wherein at least the leading face of said blade is hardened.

9. The rotor of claim 3 wherein said V-shaped free edge has an apex angle in the range of 90° to 180°.

10. In a pulper having a rotor for size reduction and defibering of large sheet stock materials held in a tank of water where the rotor has a generally circular base plate mounted for rotation by a motor about a central axis within a stator having plural peripherally arrayed lobes, each lobe having an inclined acquisition edge that interacts in a scissor fashion with the outer edge of a set of peripheral blades secured on the rotor base plate, the rotor and stator defining therebetween a reduction interface for the stock materials, the improvement comprising, a cone assembly secured at the center of the rotor base plate within the peripheral rotor blades, said cone assembly comprising, a base plate, a blade extending across said base plate and projecting into the tank, and a cone-like support structure secured to said base plate and said blade, said cone-like support structure being configured and sized with respect to said blade to provide mechanical support for the blade to resist deformation of the blade as it rotates in engagement with the materials.

11. A process of reducing in size large sheet stock materials prior to size reduction and defibering by a rotor-stator assembly mounted to operate in a tank of water that receives the large sheet stock materials and including a rotor with a generally circular base plate mounted for rotation by a motor about a central axis within a stator having plural peripherally arrayed lobes each with an inclined acquisition edge that interacts in a scissor fashion with the outer edge of a set of peripheral blades secured on the base plate, the rotor and stator defining therebetween a reduction interface, comprising the steps of, boring into the large sheet materials with an upright blade rotated about an axis through the blade, simultaneously impacting the large sheet material with a side of the blade, and supporting the blade mechanically during said boring and simultaneous impacting along a line closely spaced from its free edge.

12. The size reduction process of claim 11 further comprising the step of limiting the surface area of said blade exposed to the water and stock material in the tank.

13. A cone assembly for a rotor-stator pair of a pulper defining an attrition interface between a set of upright rotor blades mounted at the periphery of said rotor and the inner face of the stator that can operate continuously to reduce in size and defiber large sheet stock materials added to a water-filled tank of the pulper, comprising, a base plate secured to the rotor and rotating in unison with the rotor about a common axis of rotation, an upright blade extending across said base plate with a free edge projecting into the tank, said blade free edge lying within and extending above said peripheral set of upright rotor blades, and a support structure secured to said base plate and said blade, said support structure being configured and sized with respect to said blade to provide mechanical support for the blade as it engages and breaks apart the large sheet stock materials.

* * * * *